United States Patent [19]

Lasalandra

[11] 4,264,991

[45] May 5, 1981

[54] FOLDABLE BATHTUB LINER TANK

[76] Inventor: Raffaele Lasalandra, Via Di Vagno, 118, Mola di Bari, Italy

[21] Appl. No.: 42,105

[22] Filed: May 24, 1979

[30] Foreign Application Priority Data

May 25, 1978 [IT] Italy ..... 3412/78[U]

[51] Int. Cl.[3] ..... A47K 3/02; A47K 3/06; A47K 3/14; B65D 37/00

[52] U.S. Cl. ..... 4/514; 4/DIG. 18; 220/403; 220/404; 4/580; 4/546

[58] Field of Search ..... 4/160, 162, 173 R, 174, 4/177 R, 177 A, 177 CW, 183, 185 R, 185 AB, 185 B, 185 S, 185 F, DIG. 18, 166, 169, 187 R, 172.12; 220/403, 404

[56] References Cited

U.S. PATENT DOCUMENTS

| | | | |
|---|---|---|---|
| 976,199 | 11/1910 | Messenger | 4/162 |
| 1,111,094 | 9/1914 | Rehm | 4/185 AB |
| 1,948,204 | 2/1934 | Dillard | 4/162 |
| 2,614,264 | 10/1952 | Schmidt, Jr. | 4/173 R |
| 2,728,920 | 1/1956 | Hylton et al. | 4/177 R |
| 3,024,471 | 3/1962 | Anderson | 4/DIG. 18 |
| 3,045,254 | 7/1962 | Cook et al. | 4/173 R |
| 3,837,014 | 9/1974 | Sugiyama | 4/162 |
| 3,961,380 | 6/1976 | Garr | 4/162 X |
| 4,051,563 | 10/1977 | Clarke, Jr. | 4/173 R |

FOREIGN PATENT DOCUMENTS

| | | | |
|---|---|---|---|
| 290052 | 5/1928 | United Kingdom | 4/162 |

*Primary Examiner*—Stuart S. Levy
*Attorney, Agent, or Firm*—Holman & Stern

[57] ABSTRACT

A foldable tank for a bathtub in the nature of a plastic liner having an external frame that rests on the edges of the bathtub. A plastic sheet conforms to the interior surface of the tub and is held there by hydrostatic pressure when in use. The sheet is joined to the frame. A partition can be provided to compartmentalize the tank.

4 Claims, 5 Drawing Figures

FOLDABLE BATHTUB LINER TANK

The present invention relates to vessel liners and, more particularly, to liners for bathtubs which are foldable having an external rigid frame.

The present invention has as its object a vessel foldable like a book, comprising a thin sheet of plastic which is flexible and bendable and is formed so as to be able to assume the shape of the internal surface of a common, ordinary bathtub, such that the hydrostatic pressure of the liquid contained in the tank is transmitted to the bathtub by and from the sheet. In order to hold the plastic sheet in place it is joined to a rigid frame in an easily replacable fashion, which frame is placed over and rests on the edge of the bathtub.

At present, in order to arrange for a reverse supply of drinking water in a private home independently of the supply common to the whole structure of which the home is part, for example, the tap water municipal supply system, in regions in which there is a shortage of water, rigid containers are used, such as fixed or portable tanks or cisterns, muleback tanks and the like. These, when they are not being used, are a problem because of the substantial encumbrance which they present.

Additionally, the repeated use of bathtubs in hospitals, hotels and other community facilities is inadvisable from the point of view of hygiene because in order to use them, one must be sure that they have been well cleaned and disinfected. Thus, an aim of the present invention is to furnish dual solutions in a single solving means by which the above difficulties can be remedied.

The invention as described in the claims solves the following two problems equally well: To provide a personal means usable in an area where there is a shortage of water to store large quantities of potable water in one's private home, and to furnish a means by which a bathtub can be repeatedly used without danger of infection in hospitals, clinics, hotels, and other community facilities.

There are a number of advantages to be derived from this invention, namely, its utility, efficacy, convenience of application, low cost, and the ease with which the tank can be stored and transported to a location where it is conveniently and advantageously storable with minimum encumbrance.

The invention is described in some detail below with the aid of drawings which illustrate an embodiment which is particularly adapted to be used as a tank with two compartments for the storage of potable water.

Figure 1:
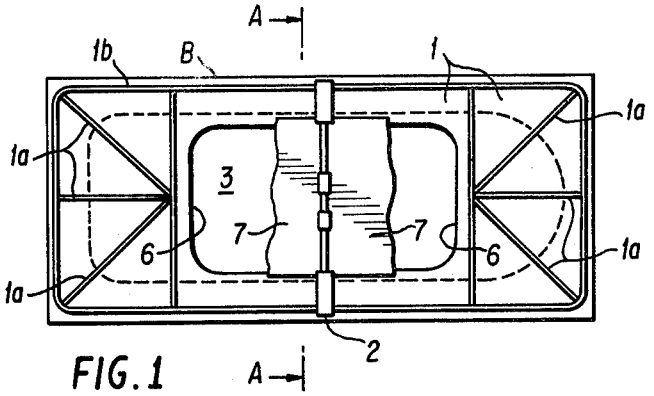
Figure 2:
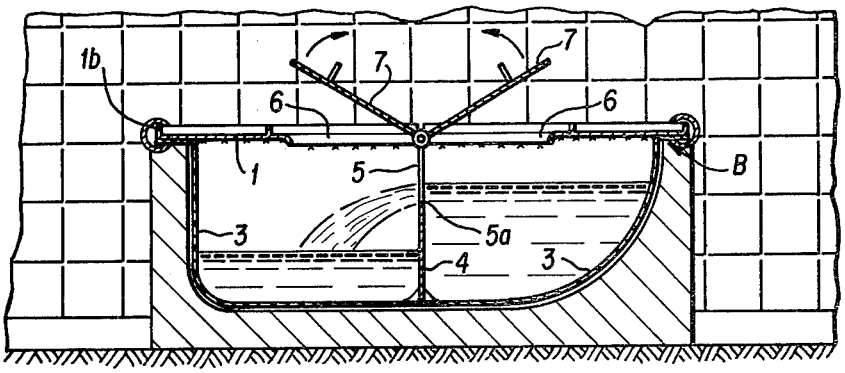
Figure 3:
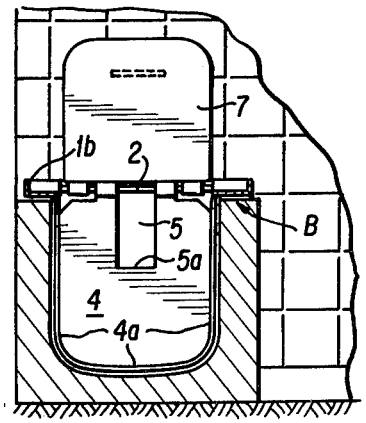
Figure 4:
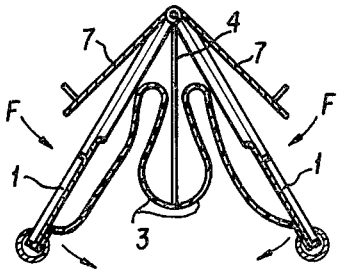

In particular, the figures on the plate of drawings illustrate:

FIG. 1: A top plan view of the inventive tank mounted in a bathtub;

FIG. 2: A longitudinal cross section of the tank;

FIG. 3: A transverse section along line A—A of FIG. 1;

FIG. 4: The tank in the folding phase; and

Figure 5:
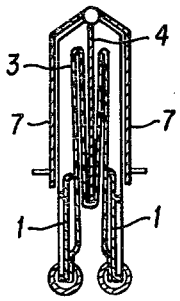

FIG. 5: The tank folded like a book.

As seen from the figures, the tank comprises horizontal plastic plate 1, which is rigid and has a suitable strength, and is of a shape which allows it to be supported on the top edge B of the bathtub, over the bathtub's entire contour.

The plate is made up of two pieces which have a hinge between them along axis 2. The hinge comprises a cylindrical shaft of sufficient strength and convenient diameter to enable the plate to be folded like a book when the tank is not in use.

The wall 3 of the tank is connected at a suitable distance from the edge of the lower face of plate 1 to the plate 1 or other frame, without a break in continuity, by suitable connecting means which enable rapid replacement. The wall 3 is made of a single thin sheet of an impermeable material which is flexible and strong, for example a sheet of polyethylene film, which has been previously formed so as to be able to assume the shape of the internal surface of a bathtub of standard shape and dimensions, and thereby continuously cover the internal surface of the bathtub.

In addition to being connected to the plate 1, the flexible wall 3 of the tank is also internally joined in its middle region along the longitudinal axis, at its side and bottom edges 4*a*, to a partition 4 which is made of a rigid material of a suitable strength, for example, plastic, which is also hinged at its upper edge at the same axis 2 at which the two sectors of plate 1 are hinged.

The partition 4 divides the tank into two compartments. There is provided an aperture 5 with a sluice, whereby if it is desired to fill up only one compartment, one may fill it through aperture 6 up to the bottom edge or threshold 5*a* of the aperture 5, and then subsequently fill up the second compartment by overflow across the bottom edge 5*a*.

If it should happen that the volume of water to be introduced into the tank is small, then the level of the water in the compartment into which it has been introduced remains very low, making it difficult to withdraw. Thus multiple compartments i.e. two or more compartments, can be used.

The apertures 6, which are provided for access to the two compartments of the tank can be closed off by covers 7; these covers 7 are also hinged at the axis 2. The plate 1 is reinforced and stiffened by radial bars 1*a*, which are constructed as a unified structure with plate 1 and are located in the vertical plane as viewed in FIG. 1 when viewing the top face of plate 1, so that the lower face can be supported on the edge B of the bathtub without impediment.

In order to further reinforce plate 1, it has a structure comprised of another bar 1*b* running along its entire perimeter, in the vertical plane i.e., as viewed in FIG. 1.

The folding of the frame around the hinge axis 2 is performed, as illustrated in FIG. 4, in the direction of the arrows F, in such a way that the entire structure assumes a shape like a book, with minimum encumbrance, i.e., occupying minimal space, as illustrated in FIG. 5.

The supporting strength and the strength holding the walls of the tank in place are provided completely by the internal surface of the bathtub, as a result of the adherence or tight contact of the walls of the tank to the internal surface of the bathtub.

In the embodiment of the invention adapted to enable hygienic use of a bathtub or to prevent either the water or the person from contacting the internal surface of the bathtub, the partition 4 can be removed from the tank or omitted from the tank as built so as to form a unified vessel. The plate 1 in this embodiment is eliminated; the plastic sheet 3, shaped to conform to the internal surface of the tub is kept in position by adhesives or adhesive strips or other similar means applied on the edges of the plastic sheet to attache the plastic sheet itself to the edges of said bathtub. One type of junction which is easy to accomplish for simple and quick replacement of the wall 3 uses strips joined together at or joined to the lower surface of the frame and parallel to its perimeter. These strips have a shape which forms a longitudinal fluting such that its surface faces the edge or perimeter of the frame.

Using an elastic shaped-piece, which is located in the center part of said fluting, it is possible to attach and make a tight contact of the top edge of the plastic sheet to the surface of the frame and the shaped-piece opposite to the strips, so as to join the sheet to the frame.

What is claimed is:

1. A foldable tank for use in a bathtub comprising a cover and support plate having a perimeter, an underside surface and apertures, said plate being adapted to be supported at said perimeter by a bathtub, said plate comprising a hinge and two pieces which are hingedly connected therewith;

a flexible and bendable sheet formed and sized to conform to the interior surface of said bathtub thereby to transfer the hydrostatic pressure of a liquid contained therein to said interior surface when in use;

joining means for joining said sheet to said plate at a suitable distance from said perimeter on said underside surface of said plate parallel to said perimeter, said means including a strip of curved shape forming a fluting such that its surface facing the corresponding edge of said plate can act to maintain said sheet in tight contact and a tensioning elastic located in the center of said fluting formed by the concavity in the shape of said strip which is bent around the edges of said plate; and covers for said apertures;

said plate being foldable along said hinge enclosing said sheet between said pieces thereby occupying minimal space when not in use.

2. Tank according to claim 1 wherein said pieces together comprise a flat frame adapted to be supported on the edges of said bathtub.

3. Tank of claim 1 further comprising a partition wall connected to said hinge interiorly of said tank dividing said tank into two compartments, said wall having a sluice aperture having a bottom edge at a height such that one compartment can be filled up to the level of said bottom edge and thereafter the second compartment can be filled.

4. Tank according to any one of claims 1, 2 or 3 wherein said sheet is polyethylene.

* * * * *

UNITED STATES PATENT AND TRADEMARK OFFICE

CERTIFICATE OF CORRECTION

PATENT NO. : 4,264,991
DATED : May 5, 1981
INVENTOR(S) : RAFFAELE LASALANDRA

It is certified that error appears in the above–identified patent and that said Letters Patent are hereby corrected as shown below:

[30] Foreign Priority Data
"Italy 3412 [U]" should be
--Italy 3412 B/78--

Signed and Sealed this

*Eleventh* Day of *August 1981*

[SEAL]

*Attest:*

GERALD J. MOSSINGHOFF

*Attesting Officer*

*Commissioner of Patents and Trademarks*